US006631957B2

(12) United States Patent
Leong

(10) Patent No.: US 6,631,957 B2
(45) Date of Patent: Oct. 14, 2003

(54) DISMANTLEABLE CHAIR

(76) Inventor: Po Shun Leong, 8546 Oso Ave., Winnetka, CA (US) 91306

( * ) Notice: Subject to any disclaimer, the term of this patent is extended or adjusted under 35 U.S.C. 154(b) by 229 days.

(21) Appl. No.: 09/874,456

(22) Filed: Jun. 4, 2001

(65) Prior Publication Data

US 2002/0063463 A1 May 30, 2002

Related U.S. Application Data

(60) Provisional application No. 60/220,399, filed on Jul. 24, 2000.

(51) Int. Cl.[7] ..... A47C 4/02

(52) U.S. Cl. ..... 297/440.13; 297/440.15; 297/440.23

(58) Field of Search ..... 297/440.1, 440.12, 297/440.13, 440.2, 440.22, 440.23, 440.15

(56) References Cited

U.S. PATENT DOCUMENTS

| | | | | |
|---|---|---|---|---|
| 2,334,912 A | * | 11/1943 | Eide | 297/440.13 |
| 2,467,664 A | | 4/1949 | Glenn | |
| 2,654,923 A | | 10/1953 | Johnson | |
| 4,139,314 A | | 2/1979 | Albern | |
| 4,188,067 A | | 2/1980 | Elmer | |
| 4,225,180 A | * | 9/1980 | Gillis | 297/271.5 |
| 4,712,837 A | * | 12/1987 | Swilley | 297/440.13 |
| 5,026,121 A | | 6/1991 | Ratalahti | |
| 5,605,378 A | | 2/1997 | Oyediran | |
| 5,765,922 A | * | 6/1998 | Hsia | 297/440.1 |
| 5,992,938 A | * | 11/1999 | Jones | 297/440.13 |
| 6,036,270 A | | 3/2000 | Bufalini | |

* cited by examiner

*Primary Examiner*—Anthony D. Barfield
(74) *Attorney, Agent, or Firm*—Bruce A. Jagger

(57) ABSTRACT

A dismantleable chair comprising a back member, leg members and a seat member all formed from generally two-dimensionally shaped materials such as plywood, and the like. The back member is somewhat arcuately shaped in both the horizontal and vertical cross-sections to provide superior seating comfort and strength. The arcuate shape also provides for a unique curved compressively pre-loaded joint design among the chair members, which substantially increases the strength and rigidity of the chair. The compressively preloaded joints are protected from bending and rotational loads by their respective positioning, and the presence of other spaced apart joints. The chair can be assembled and disassembled numerous times without loosing strength and rigidity.

15 Claims, 6 Drawing Sheets

DISMANTLEABLE CHAIR

This application claims the benefit of provisional application 60/220,399 filed Jul. 24, 2000.

BACKGROUND OF THE INVENTION

1. Field of the Invention

The invention relates in general to the field of dismantleable furniture and, in particular, to dismantleable chairs made from generally two-dimensional materials such as plywood.

2. Description of the Prior Art

Many take-apart or breakdown chairs have been proposed previously. Such chairs are typically useful where temporary seating is required, yet when they are not in use they can be conveniently disassembled and stored in a space efficient manner. Since such chairs are often temporarily used, it is often required that they cost less than conventional non-break-down or folding chairs, otherwise any additional cost could outweigh the advantages gained from their disassembleable nature. In addition, dismantleable chairs must be of sufficient strength and rigidity so as to not only be safe, but also to be comfortable and sturdy so as to impart confidence in the minds of their users. Achieving an optimized balance of these considerations has proven problematic.

For example, in U.S. Pat. No. 5,605,378 to Oyediran a take-apart chair is disclosed, which comprises five flat components. Such flat contoured chairs, however, are generally uncomfortable unless provided with a foam seat cushion. Undesirably, including a seat cushion increases the cost of the chair and is to be avoided. Also, the take-apart chair utilizes flat interlocking joints that can flex and wear over time. Such joints can undesirably diminish confidence in the minds of the users of such chairs, and even make the chair unsafe.

In U.S. Pat. No. 6,036,270 to Bufalini, a collapsible chair is also disclosed, which comprises simple flat circular shaped components that engage at straight joints held together with locking pins. This chair also suffers from the same discomfort associated with flat seat chairs, and from the straight joint design which can loose rigidity and strength over time.

Other attempts to create inexpensive dismantleable chairs include those disclosed, for example, in U.S. Pat. No. 5,765,922 to Hsia, in U.S. Pat. No. 5,992,938 to Jones, U.S. Pat. No. 4,225,180 to Gillis, U.S. Pat. No. 4,188,067 to Elmer, and in U.S. Pat. No. 4,712,837 to Swilley. These proposed expedients generally suffer from the same strength and rigidity problems, and lack of comfort, that are inherent in chairs with straight joints and flat surfaces.

Thus, there is a need to provide a dismantleable chair that is substantially more comfortable and substantially more rigid than prior art breakdown or take-apart chairs. There is also a need to provide such a dismantleable chair where the transfer of seating loads travels through as few joints as possible. There is also a need to provide a dismantleable chair at a minimum cost so as to be competitive with conventional permanently fixed chairs in cost, comfort, and strength. There is also a need to provide such a dismantleable chair that can be repeatedly assembled and disassembled simply, safely, and reliably without degrading its strength and rigidity.

These and other difficulties of the prior art have been overcome according to the present invention.

BRIEF SUMMARY OF THE INVENTION

A preferred embodiment of the dismantleable chair according to the present invention comprises, for example, a back member, two leg members, and a seat member. These components are fabricated from generally two-dimensionally shaped materials such as, for instance, plywood, plastic, laminated fiberboard, or the like.

Uniquely, the transfer of seating loads to the floor is directly accomplished at the front portion of the chair via the generally diagonally positioned continuous back member, and at the rear portion of the chair by leg members. The leg members are secured to both the seat member and the back member through compression joints. A cross support feature of the back member and the leg members through associated joints provides superior strength and rigidity compared to conventional breakdown chairs. Additionally, the leg members, seat member, and back member are all integrally interconnected through stable joints. The joints protect one another from loads that would be damaging to their integrity.

In a preferred embodiment the generally planar back member is slightly arcuate in shape, being curved somewhat in both vertical and horizontal cross-sections that are taken generally normal to its generally planar surface. The somewhat arcuate shape of the back member provides superior structural characteristics compared to other dismantleable chairs that comprise flat panel members. The somewhat arcuate back member of the present invention also provides superior comfort to the user. Because the back member is curved, it is more resistant to bending when loads are applied at the top portion of the chair. Also, the curved shape establishes curved compressively pre-loaded joints that are superior in strength and rigidity compared to straight joint connections. Because the chair is made from generally flat material that is inexpensively shaped for both comfort and strength, there is no need for cushions, making the chair extremely cost competitive even with non-breakdown chairs.

In a preferred embodiment, the curved back member has, for example, two close-ended slots that accept the leg members for attachment. At least some of the joints formed between the leg members and the back member are preferably curved joints compressively pre-loaded during assembly. Each of the leg members preferably has a seat support edge and a back support edge. These respective edges are adapted to join with the generally planar surfaces of the seat member and the back member, preferably through compressively loaded joints. These compressively pre-loaded joints resist compression and tensile loads, but, unless protected, are relatively weak in resisting bending and rotational loads. If desired, the compression joints between the seat member and leg members can also be curved. Curvature also shapes the seat member to conform to the shape of the human body. Preferably, the leg members have an open-ended notch that captively engages the back member through the closed-ended slots in order to assist in protecting the curved compressively preloaded joints from bending and rotational loads. The location of the engagement between the open ended notch in a leg member and the closed-ended slot in the back member is spaced from the compression joints so as to stabilize and protect at least one of them from bending and rotational loads.

The members of the chair in a preferred embodiment are uniquely joined, for example, in a curved compressively pre-loaded joint configuration. The curved nature of the joint tends to self stabilize it from bending and rotational loads. Preferably, the fastening member includes at least one fastener and one insert for each joint. The fastener, for example, can be a screw, and the insert can be a specially shaped nut for the screw. The joints can be achieved, for example, by mounting the nut in a pocket in one member so that the screw must pass through both members to make threaded engagement with the nut. Typically, the pocket is located in the member that bears edgewise against the other member, but this structure can be reversed, if desired. Tightening the screw in the nut draws the two members together. When the fastener is fully tightened with the insert in the pocket, the first and second members are compressively pre-loaded against one another. This nut and screw fastening member is preferred, as it is low in cost and exhibits high strength characteristics that are repeatably achieved over numerous cycles of assembly and disassembly. This fastening member is also particularly useful when the chair is made, for example, from plywood shaped members, although other fastening systems could be used, if desired.

Uniquely, in one preferred embodiment the dismantleable chair is assembled with just four fastener members. In another embodiment, which includes armrests, the chair is assembled with just six fastener members. Advantageously, both embodiments achieve the superior strength and rigidity that is normally found only in permanently assembled chairs. Although one embodiment includes arm rests, they are generally optional features as they tend to increase the cost of the chair. The armrests serve a structural function that tends to increase the strength of the chair. One useful feature is a handle hole in the back member, which can be used to assist in the manipulation of the chair in those applications where the chairs are frequently moved.

Preferably, the seat is contoured for comfort, although a flat seat member can be used if desired. Regardless of shape of the seat member, it is preferred to provide a curved edge on the seat member to mate with the shape of the back member at the location where the seat member abuts the surface of the back member. In one configuration a tab or tenon projects from the abutting edge of the seat member to engage a closed slot that is provided in the back member. The closed slot can be either a through slot or a blind slot, as may be desired. In another configuration, dowels are provided protruding from the back mount edge which engage respective mating orifices in the back member.

In embodiments where the seat member is contoured, the seat member is advantageously and economically made from a generally flat two-dimensional material such as plywood that is pressed into a somewhat arcuate shape. Generally the originally planar configuration of the seat member is apparent in the completed member. When made from plywood, the plywood can be pressed, steamed, and dried to a desired predetermined shape. The desired shape can be achieved quickly and inexpensively. This process is cost effective, inter alia, in that no waste material is generated. Uniquely, this process of forming the generally flat material into the desired contour provides sufficient comfort in the seat such that a cushion is not required. Thus, shaping the seat member and back member to conform to the contour of a seated person makes this dismantleable chair competitive with permanently built chairs and padded chairs in price, comfort, and strength.

The dismantleable chair of the present invention advantageously transfers vertical loads to the floor at the front portion of the chair directly from the generally diagonally positioned back member of the chair, thereby eliminating the need for front legs. Vertical loads are efficiently transferred to the floor at the rear portion of the chair from the seat and back member through the generally vertically oriented leg members.

BRIEF DESCRIPTION OF THE DRAWINGS

The present invention provides its benefits across a broad spectrum of dismantleable furniture. While the description which follows hereinafter is meant to be representative of a number of such applications, it is not exhaustive. As those skilled in the art will recognize, the basic methods and apparatus taught herein can be readily adapted to many uses. It is applicant's intent that this specification and the claims appended hereto be accorded a breadth in keeping with the scope and spirit of the invention being disclosed despite what might appear to be limiting language imposed by the requirements of referring to the specific examples disclosed.

Referring particularly to the drawings for the purposes of illustration and not limitation.

DETAILED DESCRIPTION OF THE PREFERRED EMBODIMENTS

Figure 1:
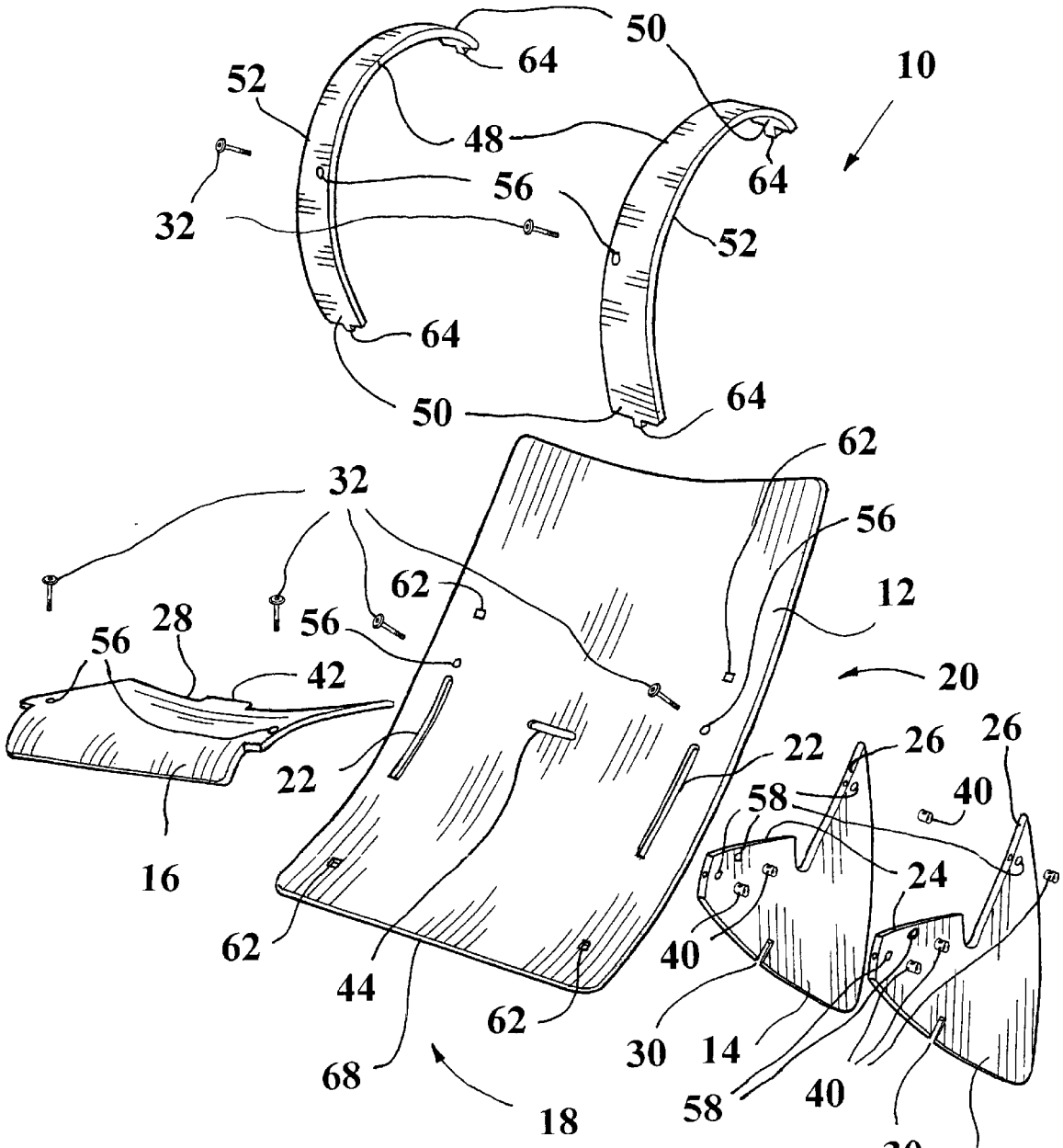
FIG. 1 is an exploded isometric view of a preferred embodiment of the invention.

Referring now to the drawings wherein like reference numerals designate identical or corresponding parts throughout the several views, there is illustrated generally at 10 a dismantleable chair of the present invention. The dismantleable chair 10 comprises a back member 12, leg members 14, and a seat member 16. These components are fabricated from generally two-dimensionally shaped materials such as, for instance, plywood, plastic, laminated fiberboard, or the like. The dismantleable chair 10 has a front portion indicated generally at 18 supported by the back member 12, and a rear portion indicated generally at 20 supported by the leg members 14. The diagonal cross support feature of the back member, which is integral over its entire length, provides superior rigidity compared to conventional take-apart chairs.

In a preferred embodiment which has been selected for purposes of illustration (see FIGS. 1 through 5), the generally planar back member 12 is somewhat arcuate in shape having curved vertical and horizontal cross-sections taken in a direction generally normal to its generally planar surface. The arcuate shape that is revealed in a generally horizontal cross-section of the back member is provided at the upper portion of the chair so as to provide a comfortable shape for one seated in the chair. The characteristics of the curve can, if desired, by adjusted over the length of the back member so that bottom edge 68 of the back member can be generally straight. The arcuate configuration, when viewed in the vertical cross-section is generally most pronounced in the just below the seat member. There the back member is swept forward so as to bring the bottom edge 68 out far enough to fully support the front of the chair. When the chair is made, for example, from flat plywood, conventional pressing, steaming, and drying methods can easily achieve this double arcuate or concave shape. This shaping is easily accomplished using the preferred five-eighths to one inch thick plywood. If flat rigid plastic is used, the shaping can be accomplished by bending and applying heat to the material.

The arcuate shape of the back member in the present invention provides superior structural characteristics compared to other dismantleable chairs that comprise flat panel members. Because the back member is somewhat bi-arcuate, it is more resistant to bending when loads are applied at the top portion of the chair. Also, the curved shape establishes curved joint connections with the other members of the chair that are stronger than straight joint connections. In addition, the arcuate shape conforms to the contour of the human body and is more comfortable than flat panel chairs. Because the chair is made from inexpensive generally two-dimensional materials that are arcuately shaped to be comfortable, there is no need to provide cushions to overcome the uncomfortable nature of flat chair members. This makes the chair is extremely cost competitive, not just with dismantleable chairs, but also with permanent non-breakdown chairs.

Figure 2:
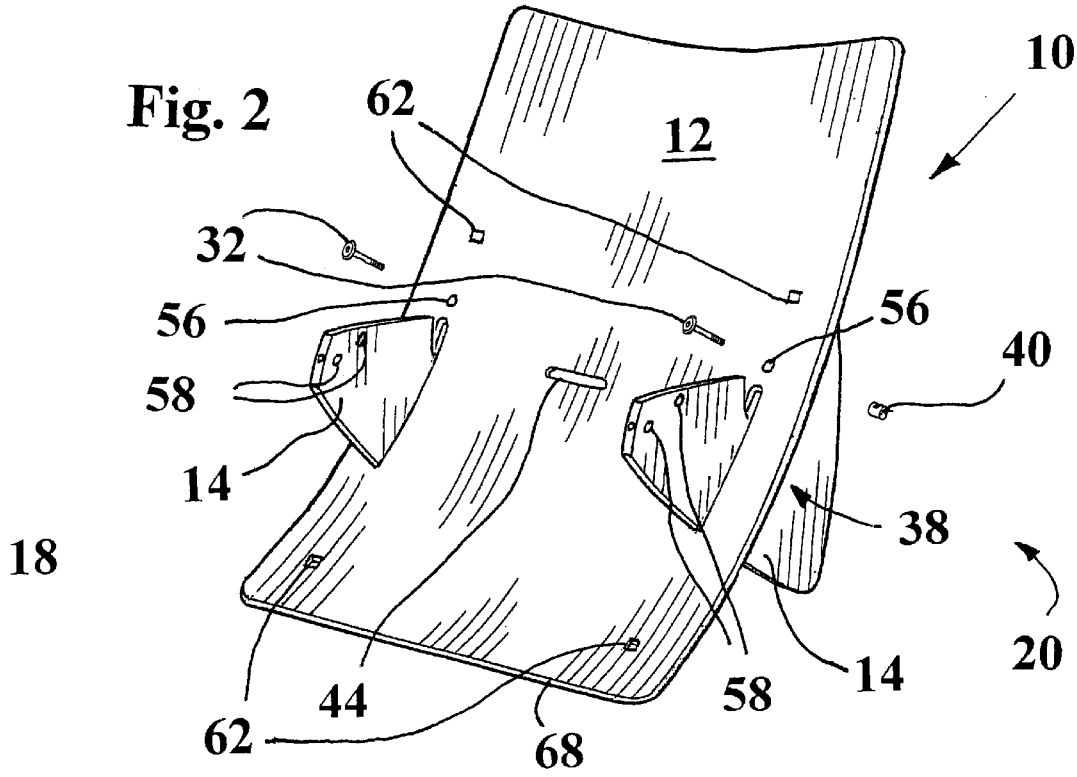
FIG. 2 is an isometric view of the embodiment shown in FIG. 1 during its assembly.
Figure 6:
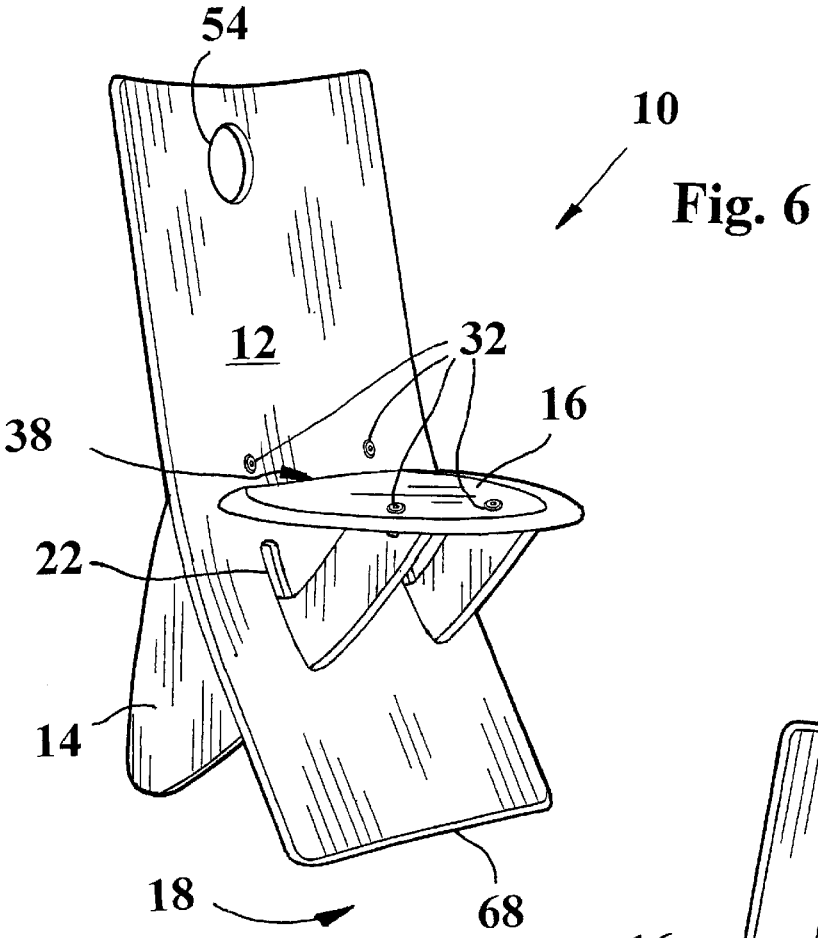
FIG. 6 is an isometric view of an alternative embodiment shown from the front side.

The back member 12 has two close-ended slots 22 that accept leg members 14 for attachment, as shown, for example, in FIGS. 2 and 6. The leg members are received in and engage with the back panel 12 so that they are mounted generally vertically in the assembled configuration. The respective leg members 14 have seat support edges 24 and back support edge 26. These edges 24 and 26 are respectively adapted to join with the seat member 16 and back member 12 to form compressive joints. Preferably, the leg members 14 also have open-ended notches 30 that captively engage the back member 12 through interengagement with one end of the close-ended slots 22. The joint which is formed by the interengagement of open slot 30 and closed slot 22 rigidifies and stabilizes the other joints. This non-compressive joint is spaced from the compressive joints 24-12 and 26-12 so as to strongly resist bending or rotating those compressive joints. Also, this non-compressive joint 30-22 prevents the back member 12 from flexing in the region below seat member 16 where the radius of its arc is generally the smallest. The non-compressive joint 22-30 supports the seat member and prevents its outer end from rotating downwardly when a person is seated in the chair. In this respect, it protects the compressive joint 12-26 from excessive tensile loads.

Figure 11:
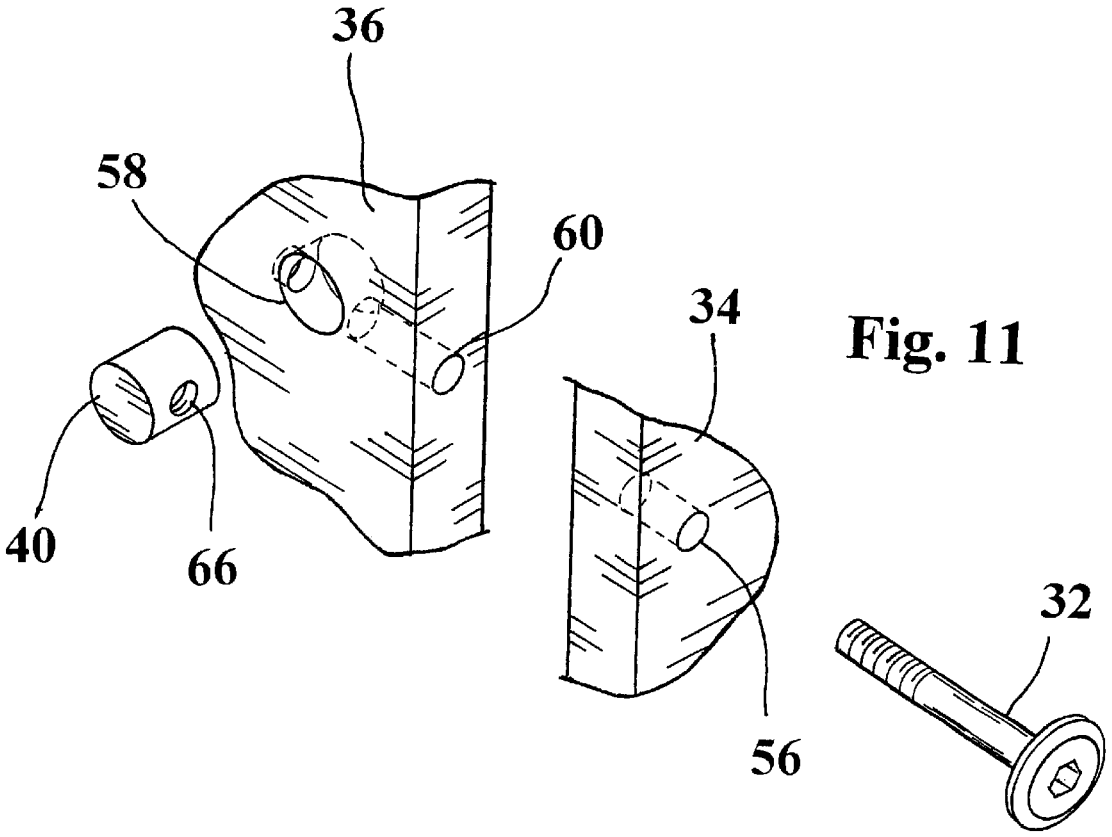
FIG. 11 is an exploded isometric view of a preferred embodiment of the manner in which compressive joints are achieved according to the present invention.

The members of the chair are preferably joined with a fastener 32 and insert 40 as shown in FIG. 11. Referring to FIG. 11 for an illustration of a preferred fastening member, a first member 34 is provided with a through hole 56 that extends generally normal to the plane of the member. The second member 36 is provided with a side hold 60, which extends generally parallel to and between the opposed planar surfaces of the member. The side hole 60 extends from an exposed edge of the member into the body of the second member 36. The first member and second member refer to any of the generally two-dimensional members that make up the chair. Thus FIG. 11 is merely representative of how the compression joints between the members are formed. An insert cavity or pocket 58 is formed in second panel 36 at a location spaced from the exposed edge of the member. Side hole 60 extends into second member 36 and intersects with insert cavity 58. Preferably, a transversely extending threaded bore 66 in insert 40 is adapted to threadably engage the threaded shank of fastener 32. Fastener 32 and insert 40 are of conventional design, and their function is well known in the art. When the fastener 32 is inserted through holes 56 and 60 and threadably engaged with the threaded bore 66 of insert 40, the first and second members are drawn together, edge to surface, and compressively pre-loaded against one another. Although other fastening means may be used to secure the various members of the chair, the fastening configuration shown in FIG. 11 is preferred due to its low cost, ease of use, and high strength characteristics.

Referring, for example, to FIG. 2, the leg members are brought through the close-ended slots 22 from the back portion 20 of the chair. The open-ended notch 30, FIG. 1, engages the back member at the lower end of the close-ended slot 22. With insert 40 fixedly engaged within the insert cavity 58 of the leg member, the fasteners 32 are then attached as shown in greater detail in FIG. 11. Preferably the back support edge 26 of the leg support member is curved to generally conform to the curved shape of the back member but such that the fasteners 32 must compressively pull the back member into a flush engagement with the back support edge of the leg member. Thus, the arc of the arcuate back member conforms to the arc of the back support edge 26 of the leg member so that these members mate to form a somewhat arcuate joint. The fasteners 32, once snugly tightened, establish the curved compressively pre-loaded joints. These curved compressively pre-loaded joints are far superior to conventional loose fitted flat joints generally found in various prior breakdown chairs. The curved joints resist flexing as compared to flat joints, and increases the rigidity of the joint. Thus, this joint configuration provides a degree of strength and rigidity in the dismantleable chair that was previously found only in permanently fixed chairs. Throughout the views, the locations of the curved compressively pre-loaded joints are generally indicated at 38.

Figure 3:
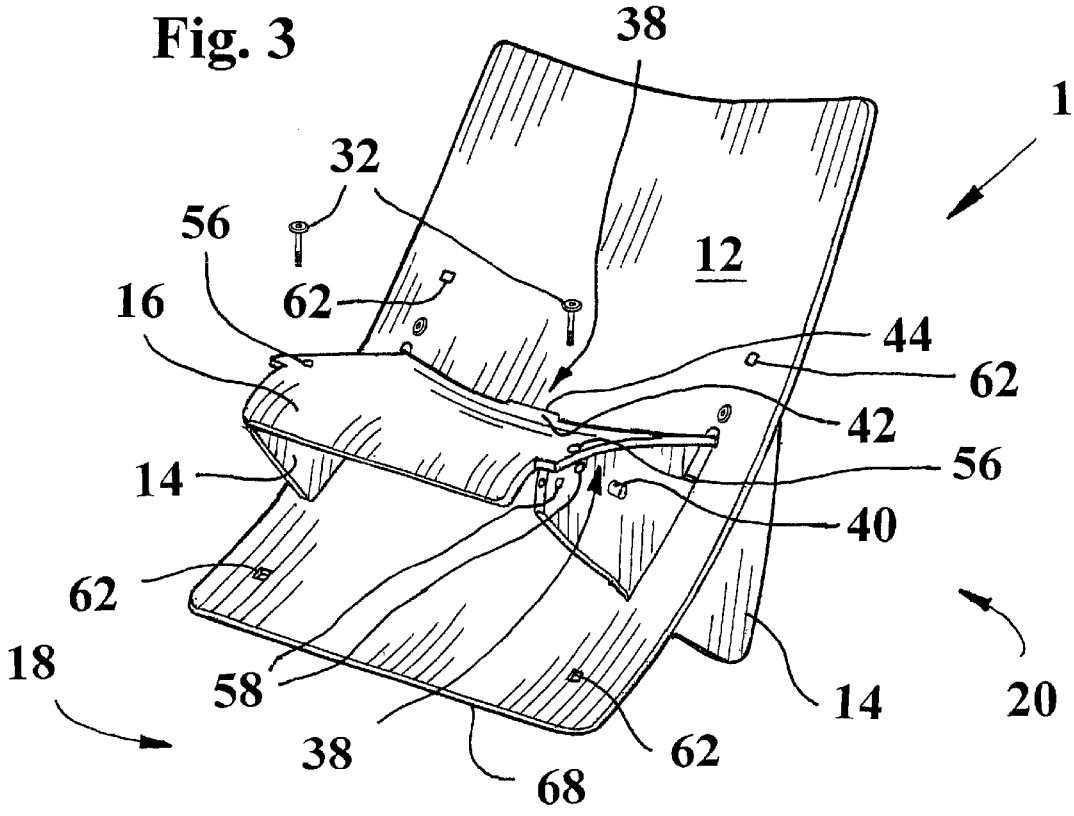
FIG. 3 is another isometric view of the embodiment shown in FIG. 1 during its assembly.
Figure 4:
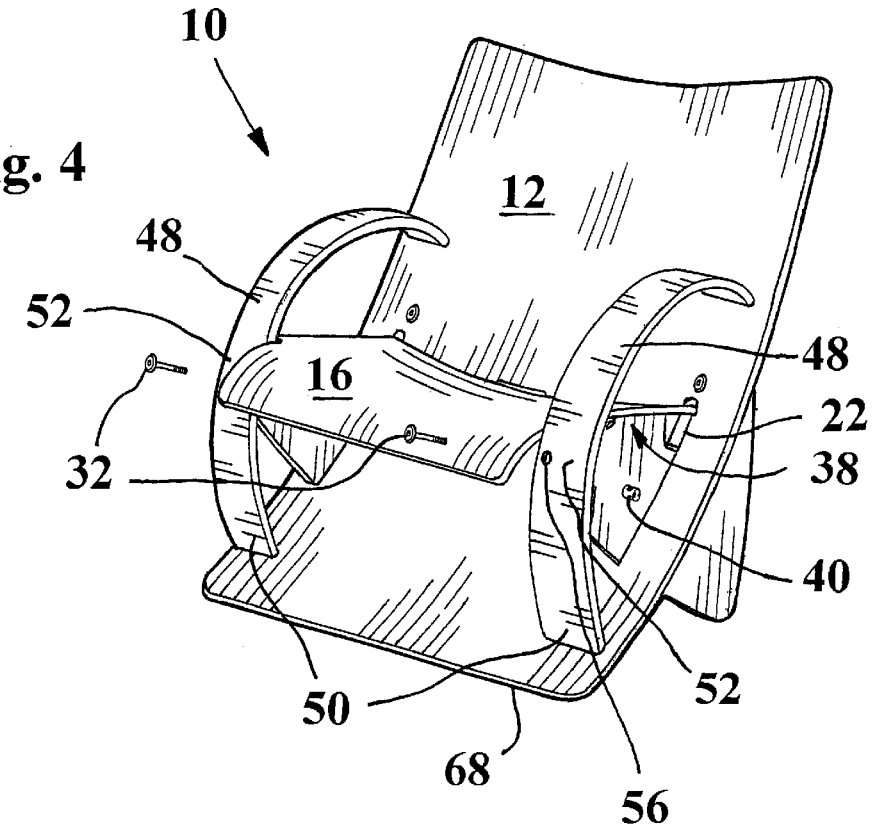
FIG. 4 is another isometric view of the embodiment shown in FIG. 1 during its assembly.
Figure 5:
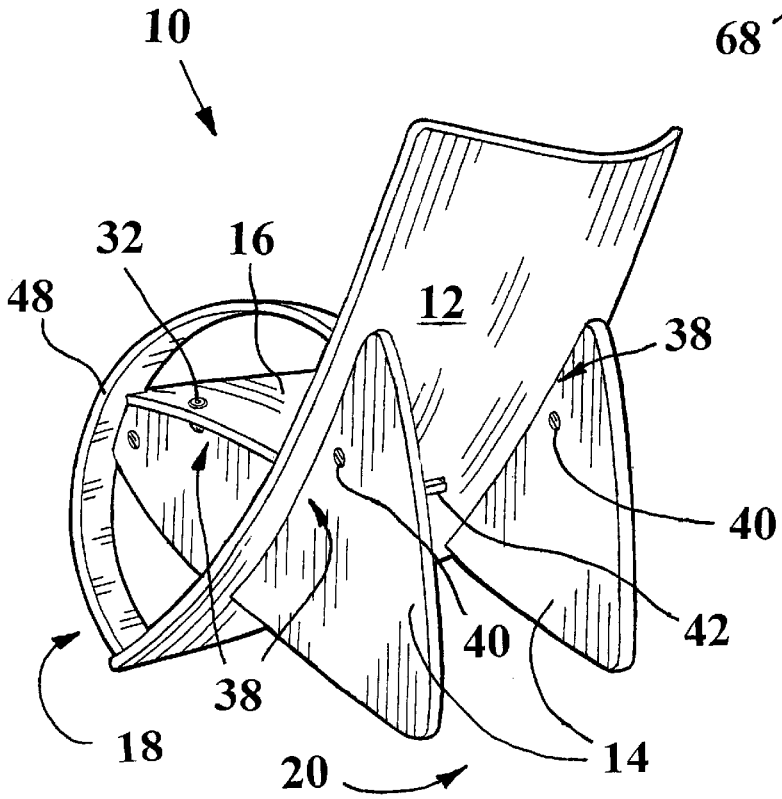
FIG. 5 is an isometric view of the embodiment shown in FIG. 1 shown from the rear side.

After the leg members are installed, the seat member 16 is then installed as shown, for example, in FIGS. 3 and 6. The seat member 16 includes a somewhat arcuate back mount edge 28 (FIGS. 1 and 8) that is adapted to mount flush against the contour of the back member 12. In this embodiment a tab 42 projects outwardly from the back mount edge 28. Tab 42 is adapted to engage a closed slot 44. Closed slot 44 is provided in the back member to accept the protruding tab 42. The seat member 16 is configured such that when the compressively pre-loaded joints 38 are established between the seat member and the leg members along the respective seat support edges 24 (joint 12-24), the back mount edge 28 is brought flush against the surface of back member 12. This provides stability to the chair.

In the embodiment shown in FIGS. 1 through 5, the chair includes two arm rest members 48. The arm rest members are also formed from a generally two-dimensional material such as plywood, plastic, laminated fiberboard, or the like, and are formed into a generally semicircular configuration as shown. Preferably, the same process is used to form the armrests and the back and seat members. The armrest members 48 have opposed ends 50 that are adapted to fixedly engage the back member 12 at spaced apart locations. A central portion 52 is adapted to being attached to a leg support member utilizing the same fastener configuration shown in FIG. 11. Four square slots 62 are provided in back member 12, which accept the respective square peg protrusions 64 that are on the opposed ends 50 of the armrest members 48. Preferably, the armrest members are sized so that in the unrestrained configuration the protrusions or tenons 64 are spaced slightly further apart than the mortises 62. Also, when the tenons 64 are engaged in mortises 62, the armrest 52 in the area of the hole 56 is spaced slightly from the mating edge of leg 14. Thus, fastener 32 deforms the arm rest member slightly as the fastener 32 is tightened in insert 40 so as to form a compression joint in the region of through hole 56. When fully assembled, the approximate mid portion of armrest 52 is drawn tightly against the leg members. This provides additional rigidity to the chair. Alternatively, the chair can also be provided without the arm rest member, if desired. See, for example, FIGS. 6 and 7.

Figure 7:
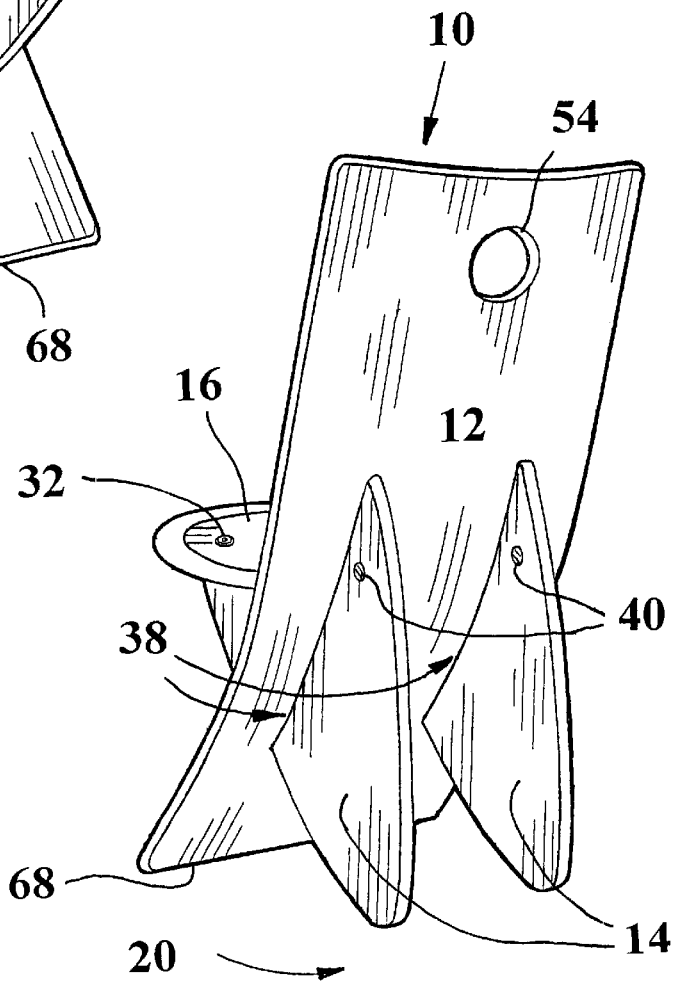
FIG. 7 is an isometric view of the embodiment shown in FIG. 6 shown from the rear side.

Uniquely, the dismantleable chair shown in FIGS. 1 through 5 is assembled with just six fastener members 32-40, and achieves the strength and rigidity equivalent to that normally found only in permanently assembled chairs. Shown in FIGS. 6 and 7 is an alternate embodiment without arm rests, which is assembled with just four fastener members. Also illustrated in this embodiment is a handle hole 54 that is advantageous in manipulating the chairs in applications where the chairs must be frequently moved.

Figure 8:
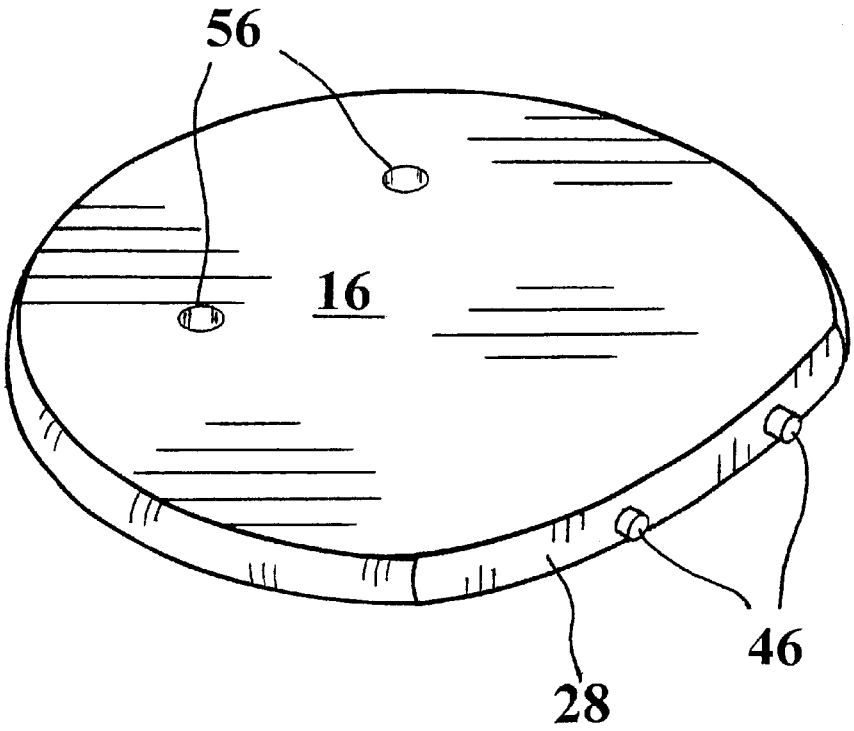
FIG. 8 is an isometric view of one embodiment of the seat of the present invention.
Figure 9:
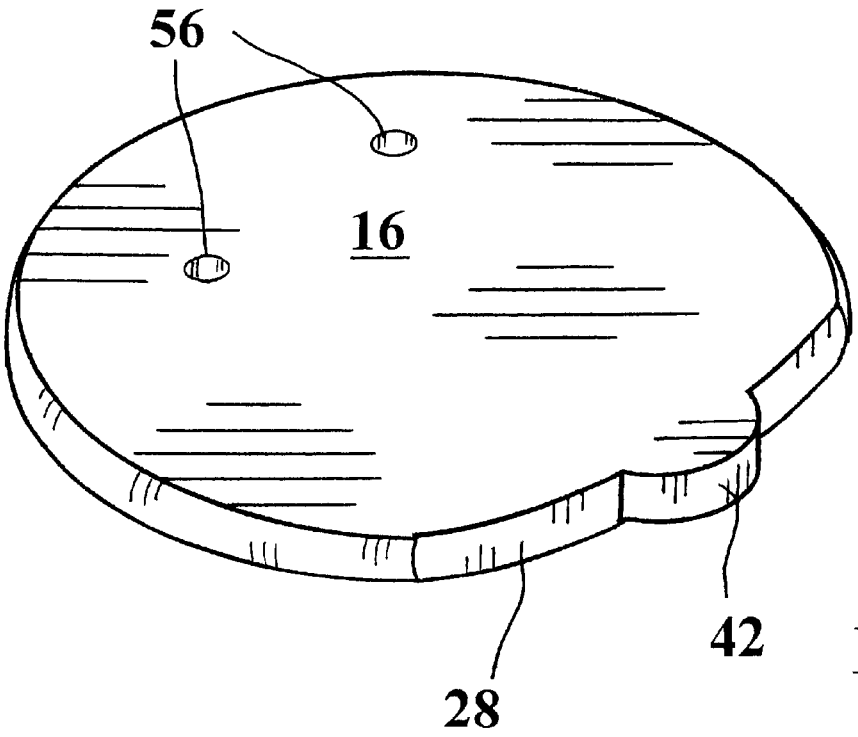
FIG. 9 is an isometric view of another embodiment of the seat of the present invention.
Figure 10:
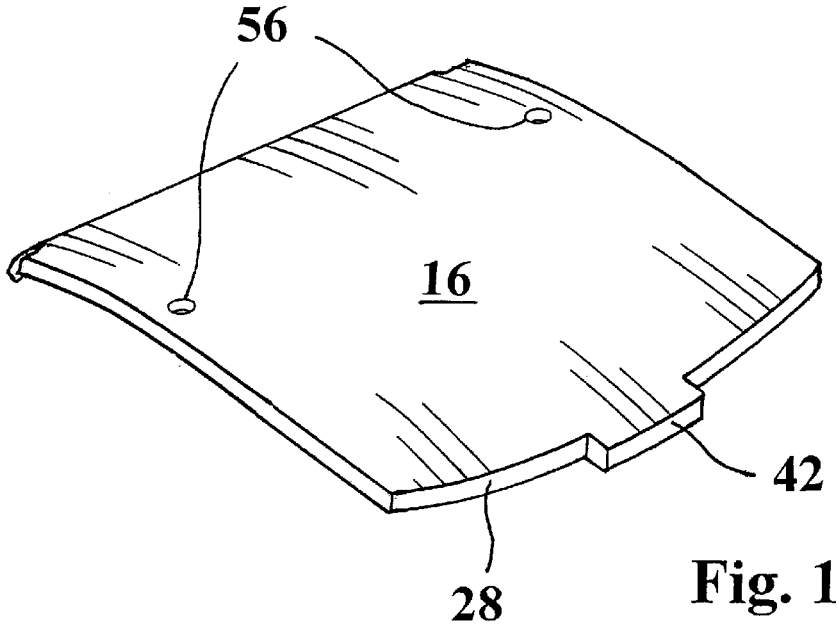
FIG. 10 is an isometric view of yet another embodiment of the seat of the present invention.

FIGS. 8 through 10 show alternative configurations of the seat member 16. FIG. 8 shows a flat seat member 16 having a curved back mount edge from which tenons or dowels 46 protrude. In this configuration a matching close fitting mortice or pocket (not shown) is provided in the back member for each dowel in the seat member 12. FIG. 9 shows a tab 42 projecting from the seat 16. Tab 42 is adapted to be received in a mating slot in the back member. The arcuate shape of the tab 42 aids in assembly and in the appearance of the assembled chair. The positioning of the seat member 16 relative to the back member 12 can be approximate at the commencement of the assembly of the seat member to the back member. As the tab 42 (FIG. 9) advances into its mating slot, the members are brought into the desired alignment by the engagement of the arcuate edges of the tab 42 with the mating slot.

The joint formed between the tab 42 and the mating mortise in the back member is a non-compressive joint. The edge 28 of the seat member 16 is held firmly against the mating surface of the back member, but it is not a compressive joint. The indication generally at 38 in FIG. 6 illustrates the compressive joints formed between the two leg members and the back member, similar to compressive joints 12-26 in FIG. 1.

FIG. 10 shows the seat member formed to comfortably conform to the anatomy of a person when seated. The desired contour of the seat member provides sufficient comfort for the user of the chair such that a cushion is not required, making the chair competitive in cost and conform with most permanently built chairs.

The dismantleable chair of the present invention advantageously transfers vertical loads to the floor at the front portion of the chair directly from the generally diagonally positioned back member of the chair thereby eliminating the need for front legs. With the elimination of front legs, so too eliminated is unnecessary load transferring front leg joints. Vertical loads transferred to the floor at the rear portion of the chair are delivered from the seat and back member to the vertical leg members through the curved compressively pre-loaded joints. As with all chairs, seating loads must transfer across the joints of the various chair members. Uniquely, the dismantleable chair of the present invention minimizes the number of load transferring joints and incorporates a curved compressively pre-loaded joint design where loads are transferred. The curved compressively pre-loaded joints are far superior in strength and rigidity as compared to the flat loose fitted joints generally found in prior expedients.

According to a preferred embodiment of the present invention, an erectable chair is constructed from panels that are approximately two dimensional. The term chair as used herein will be understood by those skilled in the art to include benches that are adapted to support more than one person or object at a time. That is, at least the starting materials from which the components of the chair are formed are generally planar. The elements of the chair are formed by slightly distorting some or all of the respective panels out of their planar configuration. The original planar configuration of the panels remains evident in the finished product. See, for example, primary panel 12 and seat panel 16. The panel components generally include a primary panel, a seat panel, and one or more leg panels.

Closed slots are provided in the respective panels to allow various of the panels to interengage in an assembled configuration. The closed slots are closed in the sense that they are fully surrounded by the material, for example, laminated wood, from which the panel is constructed. The closed slots can be blind or through slots, as desired. See, for example, closed slots 22 and 44. The mating closed slots for pins 46 in FIG. 8 are blind, while that for tenon 42 in FIG. 9 is through.

A plurality of compression fastening members serve to hold the respective panels together in the assembled configuration. The action of the compression fastening members forms compression joints at various locations between respective panels. The compression joints cooperate with the closed slots to hold the assembled chair together.

The compression fastening members can conveniently comprise, for example, nuts and bolts where the nuts are in the form of sections of rod with threaded bores extending through the rod transverse to the longitudinal axis of the rod. See, for example, FIG. 11.

During assembly, a nut, for example, in the form of a cylindrical section of rod, is inserted into a bore in a receiving panel. The nut receiving bore extends generally normal to the approximate plane of the receiving panel. A bolt is inserted through a mating panel in a direction generally normal to the approximate plane of the mating panel and generally parallel to the approximate plane of the receiving panel. The bolt intersects the threaded bore in the nut and threadably engages the nut. Tightening the bolt with respect to the nut draws the two panels together with the receiving panel extending approximately normal to the mating panel.

A compression joint between the two panels is thus formed in the region of the fastening member with the edge of one panel drawn solidly against a generally planar or, preferably, slightly arcuate surface of the other. These compression joints strongly resist tensile and compression loads. These compression joints are protected from bending, rotational, and shear loads by the interengagement of the respective panels through closed slots. The compression joints that are to be protected are spaced from the closed slots that confine the panels from tending to bend or rotate. The spacing between the compression joints and the closed slots is sufficient to prevent the anticipated loads from rotating or bending the compression joints. The interengagement of the closed slots with the respective panels prevents the panels from rotating or bending out of the intended assembled relationship. The strength of the slots is enhanced by keeping them closed, as distinct from being open at one end. The closed slot 44, for example, is spaced from all of the transverse bores 58 by a distance that is sufficient to resist rotation or bending under the anticipated loads. Closed slots 22 are likewise spaced from all of the transverse bores 58.

The primary panel preferably includes a back support portion that projects at a comfortable angle upwardly from the region of the seat panel. The seat panel generally projects approximately horizontally. The leg panels generally project generally vertically between the seat panel and the supporting substrate upon which the structure of the chair rests. The leg panels engage the supporting structure through load bearing portions. The primary panel generally also includes a load support portion that extends between the seat panel and the supporting substrate. Thus, the load support and load bearing portions support the assembly. The primary panel also includes at least one closed seat panel engaging slot and at least one closed leg panel engaging slot. The seat panel includes mating structure, for example, in the form of an extension or tenon, to engage the closed seat panel engaging slot. This interengagement can be by means of a blind mortise and tenon or by means of a through tenon in a through closed slot. The leg panel also includes a seat engaging portion and a primary panel engaging portion. Preferably, compression joints are formed between the leg panel and the primary panel at the primary panel engaging portion, and between the seat panel and the leg panel at the seat engaging portion. Additional compression joints can be provided if desired. Preferably, the compression joint formed between the seat panel and the seat engaging portion is spaced from the closed leg panel engaging slot by at least four to six inches. Likewise, the spacing between at least one of the closed seat panel engaging slots and the primary panel engaging portion should preferably be at least four to six inches.

What have been described are preferred embodiments in which modifications and changes may be made without departing from the spirit and scope of the accompanying claims.

What is claimed is:

1. A dismantleable chair having a front portion and a rear portion, said chair made from members formed from generally two-dimensionally shaped materials, said chair comprising:

a back member adapted at one end to provide support for said front portion of said chair, said back member having at least one close-ended slot extending therethrough, one leg member for each said close-ended slot, said leg members adapted to provide support for said back portion of said chair, each said leg member having a seat support edge and a back support edge, each said leg member extending through a corresponding said close-ended slot of said back member, said back member being attached to and compressively biased against each said back support edge;

a seat member having a back mount edge, said seat member being attached to and compressively biased against said seat support edge of each of said leg members and being attached to and compressively biased against said back member along said back mount edge.

2. A dismantleable chair as defined in claim 1 wherein said back member is arcuate in shape having a curved vertical and horizontal cross-section in a direction generally normal to said two-dimensions.

3. A dismantleable chair as defined in claim 2 wherein said back support edges of said leg members are curved and form curved compressively pre-loaded joints between said leg members and said back member.

4. A dismantleable chair as defined in claim 3 wherein said back mount edge of said seat member is curved and also forms a said curved compressively pre-loaded joint between said seat member and said back member.

5. A dismantleable chair as defined in claim 4 wherein each said leg member has an open-ended notch captively engaging said back member through said corresponding close-ended slots.

6. A dismantleable chair as defined in claim 5 wherein each said curved compressively pre-loaded joint between any two members of said chair comprises a fastener biasing a said first member against a second said member by threadably engaging an insert fixedly secured to a said second member.

7. A dismantleable chair as defined in claim 6 wherein said seat further comprises a tab protruding from said back mount edge and said back member further comprises a slot adapted to accept said tab when said compressive joint is made between said seat member and said back member.

8. A dismantleable chair as defined in claim 6 wherein said seat further comprises at least one dowel protruding from said back mount edge, and said back member further comprises an orifice for each said dowel adapted to accept said dowel when said compressive joint is made between said seat member and said back member.

9. A dismantleable chair as defined in claim 6 wherein said seat member is shaped to conform to the contours of the human body.

10. A dismantleable chair as defined in claim 9 further comprising two arm rest members having opposed ends and a central portion formed from generally two dimensional members arcuately shaped, said arm rest members being attached to said back member at said opposed ends and attached to said leg members at said central portion thereby establishing another said compressively pre-loaded joint.

11. A dismantleable chair having a front portion and a rear portion, said chair made from members formed from generally two-dimensionally shaped flat materials, said chair comprising:

a back member arcuately shaped in a horizontal and a vertical cross-section generally normal its said generally two-dimensional surface, said back member adapted at one end to provide support for said front portion of said chair, said back member having at least one close-ended slot extending therethrough, one leg member for each said close-ended slot, said leg members adapted to provide support for said back portion of said chair, each said leg member having a seat support edge and a back support edge, each said leg member extending through a corresponding said close-ended slot of said back member, said back member being attached to and compressively biased against each said back support edge;

a seat member having a back mount edge, said seat member being attached to and compressively biased against said seat support edge of each of said leg members and being attached to and compressively biased against said back member along said back mount edge.

12. An erectable chair including panels that are approximately two dimensional, said panels being releasably assembled to one another, said erectable chair comprising:

a primary panel that is approximately two dimensional, said primary panel having a back support portion and a load support portion, said primary panel having a closed seat panel engaging slot therein, and at least one closed leg panel engaging slot therein, said primary panel being adapted to extend approximately vertically;

a seat panel that is approximately two dimensional, said seat panel being adapted to project generally horizontally, said back support portion being adapted to being disposed generally above said seat panel, and said load support portion being adapted to being disposed generally below said seat panel, said seat panel including at least one extension adapted to engage said closed seat panel engaging slot;

at least one leg panel, said leg panel being approximately two dimensional, said leg panel being adapted to extend through said closed leg panel engaging slot and having a seat engaging portion, a load bearing portion generally opposed to said seat engaging portion, and a primary panel engaging portion, said seat engaging portion and said load bearing portion being adapted to being positioned on generally opposed sides of said primary panel, said leg panel extending approximately normal to said seat panel;

a plurality of compression fastening members adapted to compressively and releasably join said respective panels together at respective compression loaded joints, said seat engaging portion and said seat panel being adapted to being compressively and releasably joined through a said compression loaded joint that is spaced from said closed leg panel engaging slot by at least about four inches, said primary panel engaging portion being adapted to being compressively and releasably joined to said primary panel through a said compression loaded joint that is spaced from said closed leg panel engaging slot, said.

13. An erectable chair according to claim 12 including two leg panels and adapted to support one person.

14. An erectable chair according to claim 12 wherein said seat engaging portion comprises an edge of said leg panel.

15. An erectable chair according to claim 12 wherein said leg panel includes a back panel engaging notch spaced from said compression loaded joints.

* * * * *